United States Patent [19]

Muschalek, Jr.

[11] 4,356,743

[45] Nov. 2, 1982

[54] PIPE WRENCH WITH JAW HEEL END EXTENSION

[76] Inventor: Ben E. Muschalek, Jr., P.O. Box 198, McCamey, Tex. 79752

[21] Appl. No.: 185,621

[22] Filed: Sep. 9, 1980

[51] Int. Cl.[3] ..... B25B 13/58

[52] U.S. Cl. ..... 81/180 R

[58] Field of Search ..... 7/139; 81/53 R, 53 A, 81/167, 169, 180 R, 180 B

[56] References Cited

U.S. PATENT DOCUMENTS

| | | | |
|---|---|---|---|
| 685,656 | 10/1901 | Verharen | 81/167 |
| 1,380,052 | 5/1921 | Fowble | 81/167 |
| 1,469,472 | 10/1923 | Bangert | 7/139 X |
| 2,594,684 | 4/1952 | Rothe | 81/180 B X |
| 2,637,235 | 5/1953 | Licari | 81/180 R |
| 3,320,836 | 5/1967 | Hagerman | 81/180 R |
| 3,578,307 | 5/1971 | Lock | 81/167 X |

*Primary Examiner*—James G. Smith

*Attorney, Agent, or Firm*—Harvey B. Jacobson

[57] ABSTRACT

A conventional pipe wrench of the pipe including an elongated handle defining an endwise outwardly facing first jaw element on one end, a laterally offset longitudinally extending sleeve portion on the same handle end, an L-shaped jaw including short and long legs with the long leg slidably received in the sleeve portion for longitudinal shifting therethrough and the short leg opposing the aforementioned first jaw element and defining a second jaw element, and thrust structure operatively connected between the long leg of the L-shaped jaw and the handle for shifting the L-shaped jaw longitudinally of the handle, the improvement comprising a laterally outwardly projecting heel portion carried by the end of the long leg of the L-shaped jaw from which the short leg is supported and projecting laterally outwardly of the long leg in a direction opposite to the direction in which the short leg projects and with the heel portion extending outwardly beyond the sleeve portion in a manner such that the back of the wrench may be supported from a planar surface by the free end of the end heel portion and the end of the handle remote from the first jaw element with the jaw elements projecting away from the planar surface and the sleeve portion spaced from the latter.

7 Claims, 4 Drawing Figures

PIPE WRENCH WITH JAW HEEL END EXTENSION

BACKGROUND OF THE INVENTION

Conventional pipe wrenches are notoriously old and have been used for many years. The main purpose of a pipe wrench is to enable a plumber to disconnect and connect adjacent threaded pipe sections or couplings. When a threaded pipe section or coupling is to be threadedly engaged with or disengaged from a loose pipe section or fitting, a pair of pipe wrenches must be used and the two pipe wrenches may best be operated by two plumbers with each plumber manipulating a single pipe wrench. However, in many instances a plumber will send his helper or co-worker for necessary parts or other errands and difficulty then arises for the plumber should he attempt to connect or disconnect threaded pipe components. However, a conventional pipe wrench, when the handle thereof is swung in a direction toward the direction in which the jaws of the wrench open, is self-tightening and a first pipe wrench may be engaged with one end of a pipe section and disposed upon a floor or suitable similar surface while the plumber engages a second pipe wrench with a pipe section or coupling to be turned relative to the first pipe section.

If the plumber is very careful in this procedure and maintains sufficient rotary torque applied to the first pipe section in order to maintain the first pipe wrench in gripped engagement with the first pipe section, at least an initial turn of the adjacent pipe section coupling may be accomplished through the utilization of the second pipe wrench. However, each time the workman's grip on the second pipe wrench must be changed, a condition exists wherein the desired constant torque on the first pipe section in order to maintain the first pipe wrench in engagement with the first pipe section may be terminated resulting in the first pipe wrench becoming disengaged from the first pipe section.

Accordingly, a need exists for a pipe wrench construction including features thereof which will enable a floor or other similar surface supported pipe wrench to be maintained in tight gripped engagement with a pipe section, even during period of no rotational torque input to the first pipe section. In order to satisfy this need, the pipe wrench of the instant invention includes an outwardly projecting heel carried by the L-shaped jaw thereof and projecting outwardly from the jaw in a direction opposite the direction in which the jaws of the pipe wrench open. By this construction, the pipe wrench may be supported from the floor or similar surface by the projection and the free end of the wrench handle in a manner such that the weight of the jaw end of the wrench handle will maintain the wrench jaws in engagement with the associated pipe section.

Various forms of pipe wrenches including some of the general structural and operational features of the instant invention are disclosed in U.S. Pat. Nos. 119,265, 265,188, 434,409, 502,259, 685,656, 751,914, 904,109 and 1,453,155.

BRIEF DESCRIPTION OF THE INVENTION

The pipe wrench of the instant invention includes a laterally outwardly projecting heel portion supported from the L-shaped jaw thereof and which projects laterally outwardly from the jaw a distance sufficient to enable the pipe wrench to be supported from a floor or similar surface with the heel portion supporting one end of the pipe wrench and the free end of the handle supporting the other end of the pipe wrench in a manner such that all other components of the pipe wrench are spaced relative to the floor.

The main object of this invention is to provide a pipe wrench which may be floor or other similar surface supported in a manner to maintain the pipe wrench jaws in frictional engagement with a pipe section disposed therebetween.

Yet another object of this invention is to provide an improved pipe wrench which may be modified in accordance with the present invention by relatively inexpensive means.

Still another object of this invention is to provide an improved pipe wrench whose outwardly projecting heel portion may be in the form of a second jaw to be alternately used in operative association with the jaw element carried by the corresponding end of the handle of the wrench.

Another very important object of this invention is to provide a pipe wrench constructed in accordance with the preceding objects and wherein the laterally outwardly projecting heel portion is removably supported therefrom to thereby enable the pipe wrench to be used in close quarters.

A final object of this invention to be specifically enumerated herein is to provide a pipe wrench in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
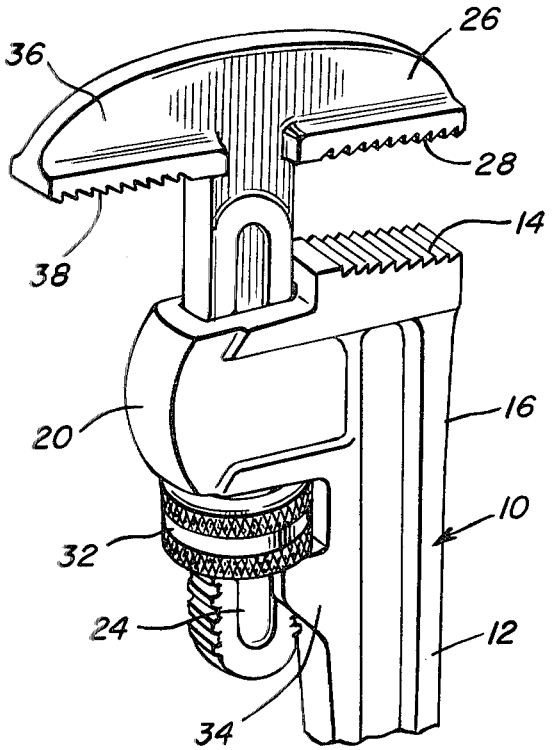
FIG. 1 is a fragmentary perspective view of a pipe wrench constructed in accordance with the present invention.
Figure 2:
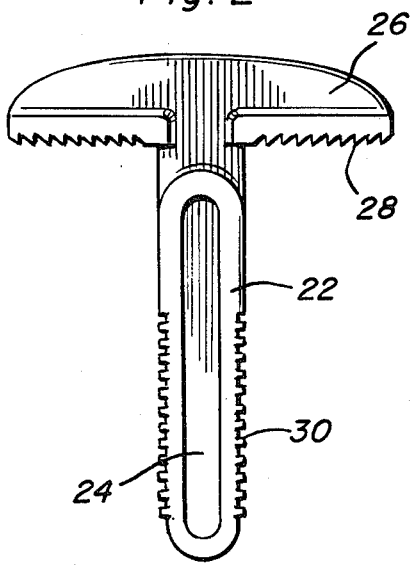
FIG. 2 is an elevational view of the slidable jaw portion of the improved pipe wrench.

Referring now more specifically to the drawings, the numeral 10 generally designates a pipe wrench constructed in accordance with present invention. The pipe wrench 10 is conventional in that it includes an elongated handle 12 defining a first toothed jaw face 14 on a first end 16 of the handle 12. The other end 18 of the handle 12 comprises the free end thereof adapted to be gripped by a plumber in turning the pipe wrench 10.

The pipe wrench 10 further includes a sleeve portion 20 supported from the first end 16 and laterally spaced to one side thereof. A jaw member 22 includes a long leg 24 slidably received through the sleeve portion and a short leg 26 disposed in substantially right angles to the long leg 24 and defining a second jaw face 28. The second jaw face 28 is disposed outwardly of and opposes the first jaw face 14.

The long leg 24 is provided with threads 30 and an internally threaded nut 32 is threadedly engaged with the long leg 24 and is received between one end of the sleeve portion 20 and a pair of latterly outwardly projecting abutments 34 carried by the handle 12. The foregoing description describes a conventional pipe wrench.

Figure 3:
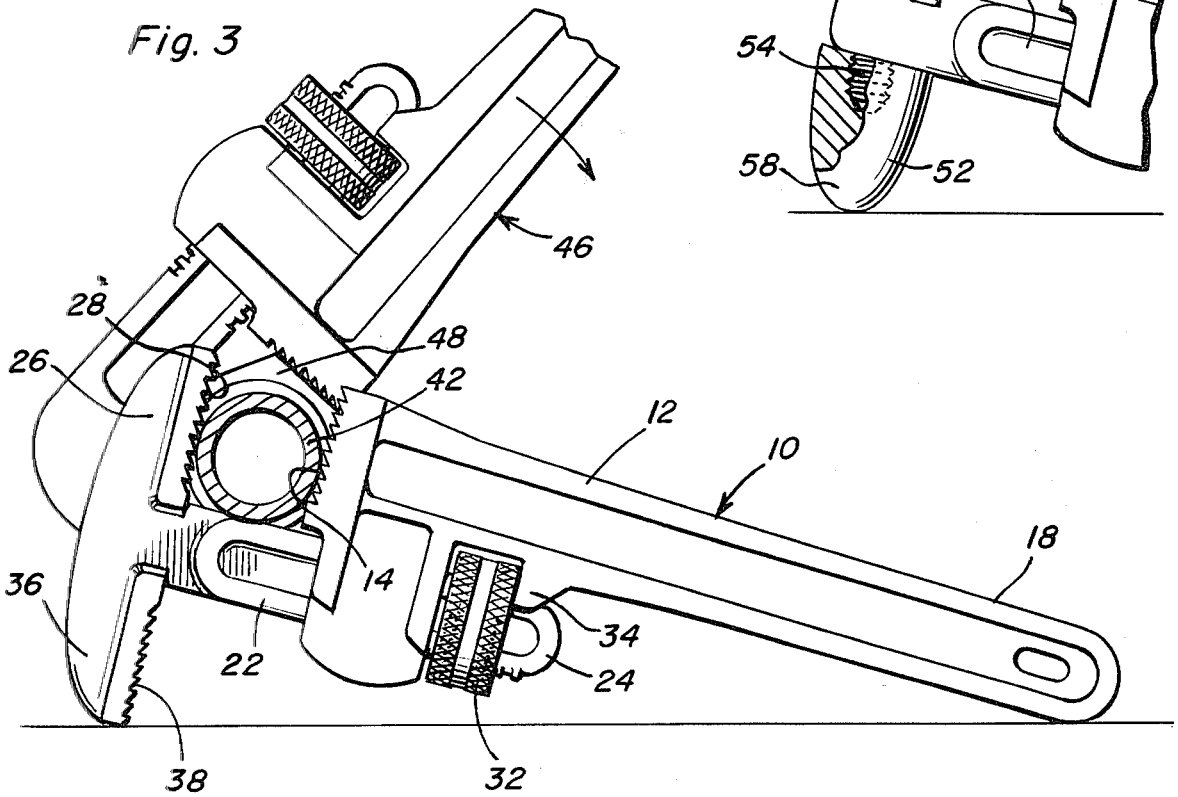
FIG. 3 is an elevational view illustrating the manner in which the pipe wrench of the instant invention as well as an additional conventional pipe wrench may be utilized to relatively turn a pipe section and an associated threaded coupling.

The jaw 22 of the pipe wrench of the instant invention includes a laterally outwardly projecting heel portion 36 carried by the end of the long leg 24 from which the short leg 26 is supported and which projects outwardly from the long leg 24 in the direction opposite to the direction in which the short leg 26 projects. The heel portion 36 comprises a substantial duplicate of the short leg 26 and defines a third jaw element 38 which may oppose the jaw element 14 when the long leg 24 is removed from the sleeve portion 20 and reinserted therein in 180° rotated position. However, as may be seen in FIG. 3, the heel portion 36 may be utilized to support the wrench 10 from a floor or other horizontal surface 40 with the wrench 10 supported only from the free end of the heel portion 36 and the terminal end of the other end 18 of the handle 12 and with the sleeve portion and nut 20 spaced from the surface 40 when in this position, one end of a pipe section 42 may be engaged by the wrench 10 and the weight of the pipe section 42 as well as contact of the heel portion 36 with the surface 40 will maintain the jaw elements 14 and 28 in frictional engagement with the pipe section 42 preventing the wrench 10 from flopping on its side and becoming disengaged with the pipe section 42. Meanwhile, a second pipe wrench referred to in general by the reference numeral 46 may be engaged with a threaded coupling 48 engaged with the pipe section 42 for the purpose of tightening the coupling 48 on the pipe section 42 in the manner illustrated in FIG. 3 of the drawings.

Figure 4:
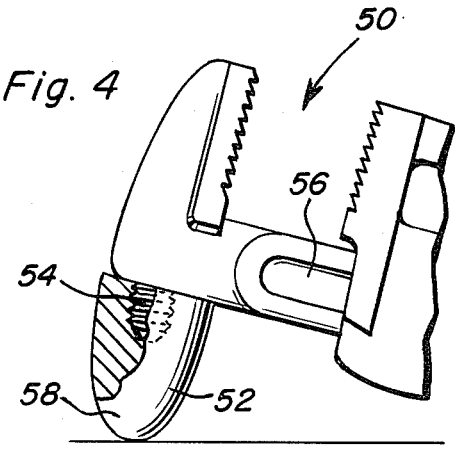
FIG. 4 is a fragmentary side elevational view of a modified form of pipe wrench constructed in accordance with the present invention.

With attention invited more specifically to FIG. 4 of the drawings, there may be seen a modified form of pipe wrench referred in general by the reference numeral 50 and which is similar to the pipe wrench 10, except that the heel portion 52 of the wrench 50 comprises an axially short threaded stud 54 projecting outwardly from the jaw 56 of the wrench 50 and a resilient cap 58 removably threadedly engaged on the stud 54. The cap 58 may be removed when additional clearance in turning a pipe section adjacent a wall or ceiling is desired. Otherwise, the projection comprising the stud 54 and cap 58 functions to maintain the wrench 50 in frictional engagement with a pipe section in the same manner in which the wrench 10 engages the pipe section 42 in FIG. 3.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a conventional, self tightening pipe wrench of the type including an elongated handle defining an endwise outwardly facing first jaw element on one end, a longitudinally extending sleeve portion on said one end, an L-shaped jaw including a long leg slidably received through said sleeve portion for longitudinal shifting along said handle and a short leg disposed at generally right angles to said long leg and defining a second jaw element disposed outwardly of and opposing the first jaw element for movement toward and away from the latter responsive to movement of said long leg toward and away from the other end of said handle, jaw shifting means operatively connected between said handle and long leg for adjustably shifting the latter along said handle and wherein angular displacement of said handle about an object engaged between said jaws, when the free end of said handle is swung in the direction in which said jaws open, causes said jaws to tighten their grip on said object; the improvement comprising a projection on said L-shaped jaw adjacent the juncture between said short and long legs and projecting outwardly from the side of said long leg remote from the side thereof outwardly from which said short leg projects, said projection extending outwardly from said long leg a sufficient distance to abut a planar surface facing in the direction in which said short leg projects, spaced outwardly of said long leg, sleeve portion and jaw shifting means and with which the other end of said handle is also abutted.

2. The wrench of claim 1 wherein said projection comprising a second short leg and said long leg may be removed from said sleeve portion and reinserted therein in 180° angularly displaced position in order to position said projection in opposition to said first jaw element and thus to enable said projection to function as a jaw element opposing said first jaw element.

3. The wrench of claim 1 wherein said projection is removably supported from said L-shaped jaw.

4. The wrench of claim 1 wherein said projection comprises a second short leg and said long leg may be removed from said sleeve portion and reinserted therein in 180° angularly displace dposition in order to position said projection in opposition to said first jaw element and thus to enable said projection to function as a jaw element opposing said first jaw element, said projection and first jaw element each including longitudinally spaced transversely extending teeth supported therefrom.

5. The wrench of claim 1 wherein said projection is integrally formed with said L-shaped jaw.

6. The wrench of claim 5 wherein said projection comprises a second short leg and said long leg may be removed from said sleeve portion and reinserted therein in 180° angularly displaced position in order to position said projection in opposition to said first jaw element and thus to enable said projection to function as a jaw element opposing said first jaw element.

7. The wrench of claim 6 wherein the first mentioned short leg projects outwardly from said long leg a distance at least equal to the distance said projection projects outwardly from said long leg thereby enabling the first mentioned short leg to function as said projection.

* * * * *